United States Patent [19]

Hertz

[11] 3,947,649

[45] Mar. 30, 1976

[54] METHOD AND APPARATUS FOR ARC QUENCHING

[75] Inventor: Walter Hertz, Erlangen-Buckenhof, Germany

[73] Assignee: Siemens Aktiengsellschaft, Munich, Germany

[22] Filed: July 25, 1974

[21] Appl. No.: 491,752

[52] U.S. Cl. ..... 200/144 R; 200/147 R; 200/150 C; 200/148 H

[51] Int. Cl.[2] ..... H01H 33/00

[58] Field of Search ..... 200/144 R, 148 H, 150 C, 200/144 B, 147 R

[56] References Cited

UNITED STATES PATENTS

| | | | |
|---|---|---|---|
| 977,193 | 11/1910 | Hunsicker | 200/150 B |
| 2,507,971 | 5/1950 | Guillaume et al. | 200/150 C |
| 2,644,877 | 7/1953 | Guillaume | 200/150 C |
| 2,908,789 | 10/1959 | Lange | 200/150 C |
| 3,725,623 | 4/1973 | Fischer et al. | 200/148 H |
| 3,849,617 | 11/1974 | Pflanz | 200/144 B |
| 3,858,076 | 12/1974 | Mitchell | 200/144 B |

*Primary Examiner*—Robert S. Macon
*Attorney, Agent, or Firm*—Kenyon & Kenyon Reilly Carr & Chapin

[57] ABSTRACT

An improved method for quenching an arc in an AC circuit breaker having an arc chamber in which the arc rotates in a quenching medium between open electrodes having ends close together in which the arc is caused to generate during its rotation, through a heating of the quenching medium, an over-pressure which is maintained beyond the zero crossing of the AC current with the gas flow produced by the over-pressure use for blasting the arc in the nozzle. Various embodiments for use in medium and high voltage switching installations which permit the switching of large currents with a simple and inexpensive arrangement are illustrated.

30 Claims, 14 Drawing Figures

CURRENT SUFFICIENT TO ROTATE ARC E OVER GAP B. BACK PRESSURE GENERATED

CURRENT SUFFICIENT TO ROTATE ARC E OVER GAP B. BACK PRESSURE GENERATED

CURRENT NEAR ZERO. ARC DOES NOT JUMP GAP. BACK PRESSURE STILL PRESENT.

BACK PRESSURE FORCES ARC INTO NOZZELS FOR EXTINGUISHMENT

METHOD AND APPARATUS FOR ARC QUENCHING

BACKGROUND OF THE INVENTION

This invention relates to AC circuit breakers in general and more particularly to an improved method and apparatus for arc quenching in such circuit breakers.

Circuit breakers in which arc quenching is accomplished by having an arc chamber in which the arc rotates in a quenching medium between open electrodes, the ends of which are situated close together, are typically used in medium voltage and high voltage installations. In particular, they are used in installations where the distribution voltage is above 1000 V. As is well known in the art, medium and high voltage circuit breakers for AC current extinguish at the zero-crossing point of the current. While in compressed-gas breakers a physically confined switching arc is subjected to the flow of a quenching gas, in breakers with a rotating arc cooling of the arc is obtained by imparting to it fast motion in a stationary gas, preferably a quenching gas and particularly sulfur hexafluoride $SF_6$. Breakers with a rotating arc require no pressure gradient in the quenching gas. Becuase of the rapid travel of the arc bases at opposite electrodes, in particular where open ring- or spiral-shaped electrodes are used, very little contact burnoff occurs and as a result, a long useful contact life is possible.

In one known embodiment of such a breaker disclosed in the journal "Elektrie," No. 10, pages 364 to 366 (1967), there is arranged in series with the switching gap a coil which produces a magnetic blasting field when the arc current flows through it and is thus referred to as a blasting coil. The contact system comprises two electrodes arranged concentrically to each other forming a ring gap in which the switching arc rotates in an arc-quenching medium under the action of the Lorentz force.

Shorted turns may also be associated with magnetic blasting coils. These cause a displacement of the magnetic field with respect to the current curve. As a result, the speed of rotation of the arc remains high as the current magnitude within a halfwave of the AC current decreases.

The arc is extinguished at the zero crossing of the current due to the cooling effect of the relative motion between the gas and the arc.

An arc-quenching arrangement which serves as an overvoltage protection device for capacitors is disclosed in German Pat. No. 1,228,334. The arc is initiated in a spark gap and rotates between ring electrodes arranged parallel to each other and whose beginning and end are situated next to each other in such a manner that they form a single layer, flat spiral. The electrodes which are situated opposite each other serve as running electrodes for the arc which rotates between them under the action of its own magnetic field until a mechanically moved insulating member used as a deflector for the arc, deflects and lengthens the arc to a quenching device consisting essentially of horn-shaped electrodes. The motion of the arc is increased between the horn-shaped electrodes by blasting coils, through which the current being interrupted flows.

The quenching of an arc by cooling at the surfaces of an insulator body is described in German Pat. No. 819,268. As disclosed therein, an inner electrode is coaxially enclosed by a ring electrode in AC breaker having a blasting coil whose inner turn forms the periphery of a cylindrical quenching chamber serving at the same time as the electrode for the arc. An arc is drawn between the electrodes using a movable contact and rotates between the electrodes on a circular path. Quenching of the arc by the cooling effect of the relative motion is further aided in this breaker by the cooling effect of the bottom and top of the flat quenching chamber.

Although these prior art methods and apparatus work reasonably well, there is a need for improved methods of arc quenching due to various deficiencies. Prior to summarizing the present invention, a discussion of the operation of gas flow breakers which operation is helpful in understanding the present invention will be given.

In what are referred to as gas flow breakers, i.e., high capacity circuit breakers using flowing gas as a quenching medium, in which the arc burns in nozzle arrangments, the switching capacity is heavily influenced by what is referred to as back-up effect. Back-up effect is a certain interaction between the quenching gas flow and the arc. In a gas flow breaker the arc burns between two contacts, at least one of which is generally shaped as a tubular contact and forms at the same time a nozzle for the gas flow. However, it is also possible for the contacts to be preceded by a separate nozzle. The basic characteristic of all these arrangements is that the arc must burn through a hollow space. The hollow space may be cylindrical, conical or Laval-tube shape and may be of different length. The quenching medium must flow through this hollow space forming the nozzle or acting as a nozzle. The quenching medium flow will be impeded by an arc therein. Using simple model concepts, two zones can be distinguished within the nozzle, an inner hot zone with low density and an outer cold zone with high density. The inner zone is formed by the arc while the major portion of the total mass passing through the nozzle flows through the outer cold zone. The thicker the arc becomes, the wider the hot zone becomes. This happens at the expense of the cold outer zone. As a result, with increasing arc thickness, the mass flow through the nozzle declines. If the arc completely fills the nozzle cross-section, mass flow is minimal.

Thus, flow resistance in the nozzle increases as a function of the power of the arc. At the same time, the mass flow through the nozzle decreases as a function of the temperature. The removal of the gas heated in the quenching chamber for the duration of the arc requires a certain amount of time, particularly where large currents are being switched. Furthermore, the gas flow adjusts itself only subsequently with a time delay because of the mass inertia. In an AC circuit breaker, the arc current varies in accordance with the sinusoidal waveform of the current half-waves. In interrupting a large current, particularly a short-circuit current, the effects mentioned above occur in the vicinity of the current maximum.

With increasing cooling-down of the arc, a radial gas flow inward occurs and thereby a corresponding increase in density. An additional annular cross section is thus made available for the gas flow. At the zero crossing of the current, the undisturbed steady-state flow which depends only on the pressure is not yet reestablished but is reduced by a predetermined amount. This flow reduction impedes the cooling of the arc and the development of a temperature distribution favorable for quenching at the important time interval just prior to the zero crossing.

The reduced cooling effect in dependence on the decreasing mass flow has a consequence that the power released in the quenching chamber cannot be removed by the quenching medium. One result of this is a large pressure increase in the quenching chamber. The pressure increase can lead not only to a reduction of the inflow from the high-pressure part of the circuit breaker, but even to a reversal of the flow direction. Through such a reverse flow, hot gas can get into the supply canals. If with a then decreasing magnitude of the current, the gas flow resumes in the desired direction, quenching medium which has already been heated and which may be contaminated with metal vapor from the electrodes flows first into the quenching arrangement. Because of these effects, designs which largely suppress the back-up effect using the special measures have been developed. Typical are the measured disclosed in ETZ-A, vol. 90, no. 26, pages 711 to 714 (1969). In gas flow breakers, the back-up effect is prevented primarily by making the discharge openings of the nozzles relatively large, in accordance with the power to be interrupted.

SUMMARY OF THE INVENTION

In the literature, only the special case of back-up which takes place when the arc itself burns through the nozzle is discussed. The present invention is based on the fact that a back-up can also occur even if the arc does not burn in the nozzle. It is this basic fact which permits the method of the present invention to provide improved operation in the rotating arc type of circuit breaker mentioned at the outset. The change of mass flow through the discharge openings designed as a nozzle is physically important. As the density decreases with increasing temperature at a rate faster than the maximum sound velocity possible at the constriction of the nozzle, a reduction of the mass flow necessarily follows. Such also happens if the arc burns within a limited volume, e.g., within an arc chamber, not through the nozzle but in the vicinity of the nozzle, e.g., on its edge, thereby heating the quenching gas.

The back-up effect which occurs in conjunction with the known quenching of an arc by rotation between electrodes arranged parallel to each other can lead to a particularly advantageous quenching effect. Thus, the present invention essentially comprises using the arc to generate during its rotation an overpressure due to heating of the quenching medium is maintained beyond the zero crossing of the AC current and which thereby results in a gas flow of the quenching medium which is used for blasting the arc in a nozzle. With the method of the present invention, a back-up effect is this generated in order to bring about, during the current half-wave, a pressure build-up in the arc chamber, which then results in a flow of the quenching medium through the nozzles.

The arc revolves in an arc chamber made of insulating material under the action of the magnetic fields generated by the arc current. It rotates on electrodes disposed opposite each other and which are preferably designed as bars. The electrodes may be in the shape of open-ring electrodes or may form a spiral. The ends of the electrodes are situated next to each other and one end connected to a current lead with the other end having a nozzle-like opening. The nozzle establishes a connection with an adjacent chamber which is referred to as an equilization chamber. Quenching medium, particularly sulfur hexafluoride $SF_6$, which is heated by the arc in the arc chamber can then flow through the nozzle into the equilization chamber. The nozzle is designed so that during the gas flow of the quenching medium, a back-up effect occurs, thereby resulting in an overpressure in the arc chamber. As a result, the flow of quenching medium continues beyond the current zero crossing and drives the arc bases, which can no longer be moved away from the nozzle over an insultaing gap by the current dependent magnetic forces just prior to zero crossing, into the nozzles. In this process, the portions of the arc in the vicinity of the nozzle and within the nozzle are cooled intensively.

Contrary to the known gas flow breakers, intensive flow cooling is achieved only in the immediate vicinity of the time of the current zero crossing, i.e., only at that time is the arc in the vicinity of the nozzle. It has been discovered that it is advantageous that the arc be cooled as little as possible during the rotation phase, in order to keep the power conversion as low as possible. For this reason, particularly fast rotation is not required. The rotation of the arc is used primarily to reduce burn-off of the electrodes and to heat the quenching medium in the arc chamber as uniformly as possible.

When the current is being switched off, the arc can be drawn from one electrode to the other in a simple fashion using a switching bar, which in the closed condition protrudes through the nozzles disposed opposite each other in the arc quenching chamber. Thus, a switching rod moveable in its length-wise direction is provided for operating the breaker. Similarly, a switching tube may also be used. For establishing good contact, at least one of the nozzles can be equipped with spring contacts or a pressure contact device of well known design.

In some cases, a single equalization chamber arranged above or below a cylindrical arc-quenching chamber may be sufficient. In such an arrangement, quenching gas flows from one side of the chamber through a nozzle and the arc is accordingly influenced by the flow only on one side. With such an arrangement of the switching apparatus, the end of the other electrode opposite the nozzle can advantageously be provided with a pressure or finger contact arrangement of known design.

The end of the switching rod is then connected with this contact arrangement when the breaker is closed. The switching tube or rod moveably arranged in one or two nozzles can additionally be guided by a sliding contact disposed in the equalization chamber. In an arrangement where two equalization chambers are used, such a sliding contact can further be provided in addition to the second equalization chamber. In one disclosed embodiment, the electrodes comprise a spiral electrode with several turns having a mutual spacing of turns which is non-uniform such that a narrow gap is produced in at least one place. The narrow gap facilitates the jumping of the arc between adjacent turns of the electrodes in the case of large currents. The electrodes are connected electrically in series and magnetically opposing each other so that what is referred to as a cusp field is produced between opposing electrodes. Such a field has a magnetic component directed radially toward the electrodes which generates a tangentially-directed force on the arc, making the arc rotate.

In another disclosed embodiment of apparatus for implementing the present method, electrodes which contain discharge nozzles in several places for conducting the quenching medium from the arc chamber to the equilization chamber are provided. The additional nozzles are disposed at points of the electrodes where it can be expected that the base points of the arc will remain stationary for small magnitudes of the current due to the greater curvature or an insulating interruption. In such a case, the magnetic driving forces will no longer be sufficient to move the base points away from these electrode parts. The sum of the inside nozzle cross sections is chosen such that the back-up effect, which is advantageous for the generation of the flow, can still take place.

In each of the disclosed arrangements for implementing the method of the present invention, it is advantageous to embed the electrodes of conductive material along with at least one nozzle in slots of insulating plates or walls of the arc chamber. This prevents the highly curved, voltage-carrying edges from projecting into the arc chamber and improves the dielectric strength of the chamber considerably.

In the equlization chambers, additional magnetic blasting coils will preferably be provided. The blasting coils are connected to the electrodes and their current leads in such a manner that they are bridged, i.e., electrically shorted, by the switching rod or the switching tube when the breaker is closed. Thus, they are in the circuit only during the switching process. The blasting coils may further be associated with at least one shorted turn which produces a phase shift of the magnetic field with respect to the arc current. As a result, the driving force acting on the arc current will remain relatively large even shortly prior to the zero crossing of the current.

In one disclosed embodiment of the invention for carrying out the method, an arc chamber is shaped as a ring with one or two equalization chambers also in the shape of the ring arranged concentric to the arc chamber. In such a case, the electrodes are situated on the inside cylindrical surface of such an arc chamber. In this embodiment, the arc driven by the magnetic forces burns in a radial direction to the axis of the chambers and its plane of motion forms a circular ring.

In the annular equilization chamber surrounding the arc chamber, additional turns can be arranged and included in the circuit only when the current is being switched. These turns generate in the arc chamber, a magnetic field with a predominantly axial component, which is therefore perpendicular to the arc and constitutes an additional driving force. Additional turns can also be provided with at least one short-circuited turn through which a phase shift of the magnetic field with respect to the current can be produced.

For limiting the current, electric resistors which are switched into the circuit upon operation of the breaker and thereby limit the current to be interrupted, e.g., a short-circuit current, to a low value can be included in the equalization chambers in addition to or instead of the coils.

A particular advantage of the apparatus disclosed is that several switching devices can be connected in series in a simple manner with a common drive associated with the switching rod of the individual switching devices.

In addition to a gaseous quenching medium such as sulfur hexafluoride, the quenching device according to the present invention can also be operated with a liquid quenching medium such as oil. In such an embodiment, the oil evaporates due to the arc and the oil vapor is used for blasting at least one of the arc bases. In such a case, it is advantageous to provide the equalization chambers with valves which allow the decomposition products to discharge to the outside.

A particularly advantageous embodiment of the quenching arrangement using a liquid quenching medium is obtained through the use of liquid sulfur hexafluoride $SF_6$. Liquid $SF_6$ has a vapor pressure of 21 atmg at 20° C and still about 5.1 atm abs at −30° C. Thus, at normal ambient temperature, e.g., between 0° and 30° C, an $SF_6$ gas atmosphere of 13 to 27 atm abs in a switching chamber partially filled with liquid sulfur hexafluoride $SF_6$ is present. This causes a substantial increase of the dielectric strength as compared to a breaker operated only with a pure $SF_6$ gas atmosphere of about 5 to 7 atm abs. Since the decomposition products of sulfur hexafluoride recombine to again form sulfur hexafluoride upon cooling down, a discharge of the decomposition products to the outside is not necessary where this is used as the quenching medium. This is a great advantage, particularly for an installation in an encapsulated system.

A further advantageous feature of the quenching aparatus of the present invention is the inclusion between the arc chamber and the equalization chamber of a discharge opening which is closed and opened as a function of the magnitude of the current to be interrupted. For this purpose, the closing mechanism can be provided with a magnetic setting device which opens the discharge opening in steps for predetermined current values. Through the use of this device, the switching arrangement is provided with optimum quenching properties over a wide range of currents.

DETAILED DESCRIPTION OF THE PREFERRED EMBODIMENT

Figure 1:
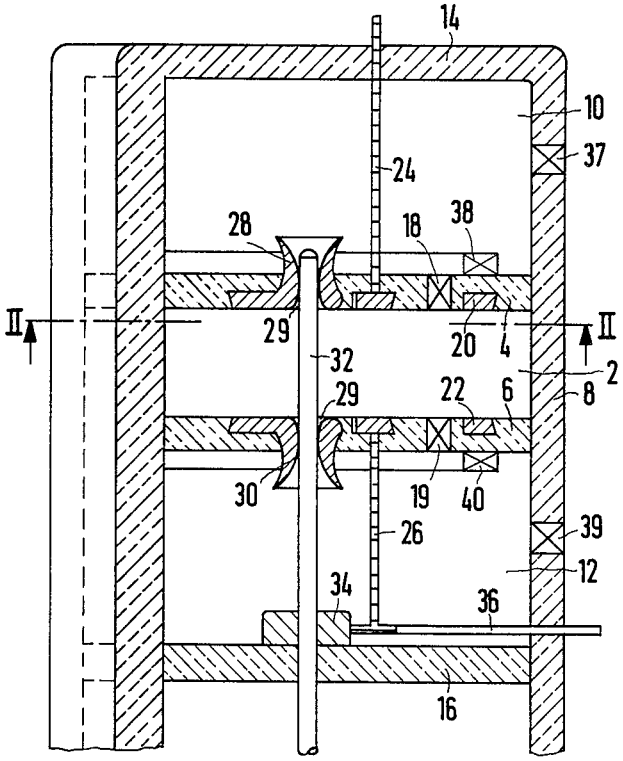
FIG. 1 is a cross-sectional view of a first embodiment of a quenching arrangement having two equalization chambers.

A first embodiment of a quenching arrangement for carrying out the method of the present invention is illustrated on FIG. 1. An essentially cylindrically shaped member 8 having a top cover 14 is provided. Centrally located within this cylindrical structure is a quenching chamber 2 defined by a top partition 4 and a bottom partition 6 along with the cylindrical side walls of the cylindrical member 8. The space between the partition 4 and the top 14 forms a first equalization chamber. A partition 16 along with the partition 6 forms a second equalizaation chamber 12. As illustrated, the equalization chamber 10 is above the quenching chamber 2 and the equalization chamber 12 below the quenching chamber 2. The walls of the chambers including the cylindrical wall 8, the top 14, bottom 16 and partitions 4 and 6 may advantageously be made of a heat resistant insulating material, such as ceramic or plastic. At the inside surface of the partition 4 of the arc chamber 2 and at its bottom partition 6, also on the inside, are arranged respective electrodes 20 and 22. One end of the electrode 20 is connected with an electrical lead 24 and one end of the electrode 22 with an electrical lead 26. The other end of the electrode 20 is designed as a nozzle 28 and that of the electrode 22 as a nozzle 30. The nozzles 28 and 30 form respective openings in the partitions 4 and 6. A switching rod 32 having an outside diameter matching the inside diameter of nozzles 28 and 30, protrudes through both nozzles, establishing the electrical connection between the electrodes 20 and 22. The switching rod can be moved along its axis by a drive, not shown. It is brought through a corresponding opening in the bottom 16 of the lower equalization chamber 12 and will preferably be guided in an additional sliding contact 34 arranged at the bottom partition 16. As shown, it can be electrically connected with the lead 26 along with being connected to a current supply line 36. The two equalization chambers 10 and 12 can also have therein a magnet coil. Shown is a magnet coil 38 in chamber 10 and a magnet coil 40 in chamber 12. These produce a magnetic blasting field for the arc which is drawn between the electrodes 20 and 22 using the switching rod 32. The blasting coils 38 and 40, whose electrical conductor connections are not shown in the figure, are connected electrically in series and in magnetic opposition. At least one short-circuited turn, also not shown on the figure, can be associated with each of the blasting coils 38 and 40 to cause, in a well known fashion, a phase shift of the magnetic field of the blasting coil with respect to the arc current producing the field. These short-circuit turns may be arranged, for example, directly at the coils 38 and 40 or may partially surround the coils. With such an arrangement, they will have a particularly close coupling with the coils.

Between the arc chamber 2 and the equilization chambers 10 and 12, respective check valves 18 and 19 are provided. These are adjusted so that they open only upon exceeding a predetermined maximum pressure in the arc chamber 2. They thereby make possible a reduction of the pressure by providing openings in addition to the nozzles. Also shown on FIG. 1 are safety valves 37 and 39 in the wall 8 at the chambers 10 and 12 respectively. These safety valves which vent to the outside are set to a predetermined maximum pressure and may, for example, be spring valves or burst diaphragms. These safety devices prevent an explosion of the switching device if the current being interrupted assumes values which cannot be interrupted by the circuit breaker. Either one or both of the safety valves 37 and 39 may be advantageously included.

Figure 2:
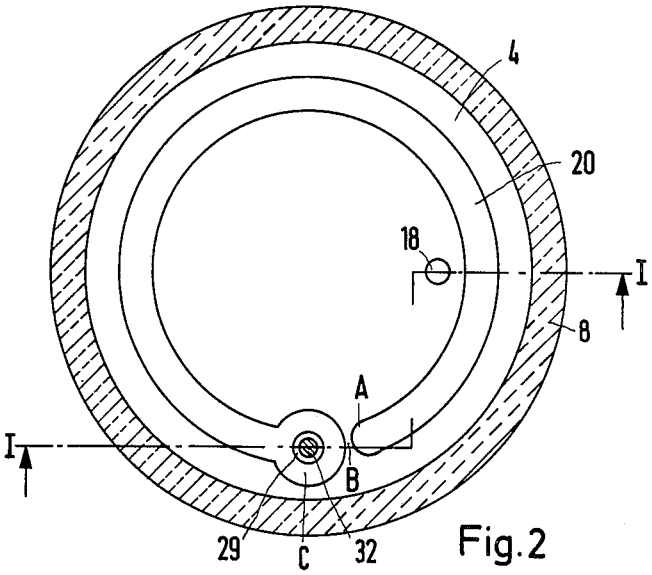
FIG. 2 is a plan view partially in cross-section illustrating a type of electrode which can be used in the embodiment of FIG. 1.

As is evident from the cross-sectional plan view through the arc chamber 2 as shown on FIG. 2, the electrode 20 is an open ring electrode which has an approximately uniform distance from the chamber wall 8 and whose ends A and C form an opening B in the ring. The end C has a larger cross section with its inner opening 29 forming the nozzle whose cross-sectional profile is laid out for aerodynamic acceleration and preferably may have the profile of a Laval tube.

Figure 3:
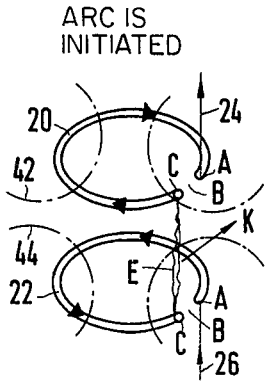
FIG. 3 is a perspective view illustrating current flow through the electrode of FIG. 2 and the magnetic fields generated thereby.

During a half-wave of the operating current, which as illustrated on FIG. 3, flows through the lead 26 along with electrode 22 in the direction indicated by the arrow, an arc E is drawn between the ends C of the electrodes 20 and 22 as the switching rod 32 is moved downward. In the electrode 20, the current flows in the opposite direction, also as indicated by arrows on FIG. 3, and leaves the quenching arrangement through the lead 24.

Figure 3A:
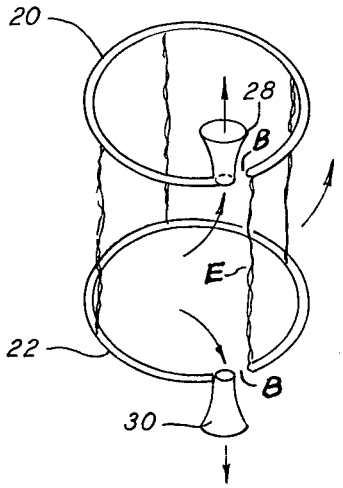
FIG. 3*a* is a similar view showing the arc rotating during which time back pressure is generated.
Figure 3B:
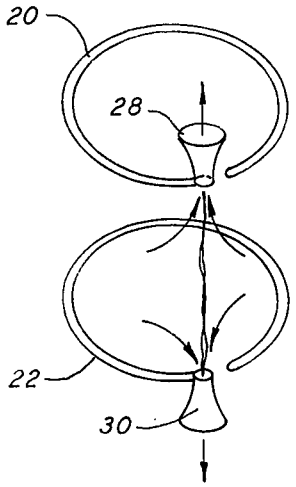
FIG. 3*b* is a view of the same arrangement at the point where the current becomes near zero so that the arc will no longer jump the gap.
Figure 3C:
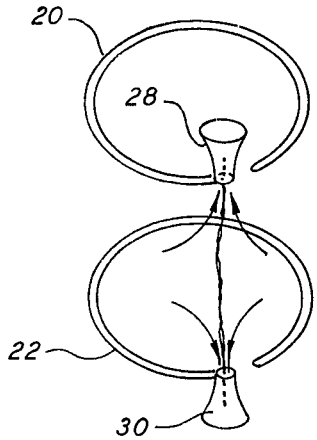
FIG. 3*c* is a similar view showing the arc being driven into the gap into the nozzles for extinguishment.

With the directions of current indicated, the two ring-shaped electrodes 20 and 22 form what is referred to as a cusp field designated by 42 and 44 and shown in dot-dash lines on the figure. The cusp field has a radial component which generates a force K acting on the arc E in the tangential direction in the space between the electrodes 20 and 22. The arc is also driven by the action of its own electromagnetic force. The latter is produced by the loop formation of the electrode parts adjacent to the ends C with the arc E. The arc E is driven by this force over the ring opening B and it rotates between the electrodes 20 and 22 as shown by FIG. 3*a* until the magnitude of its current has fallen to a predetermined value within the half-wave. At this point, illustrated by FIG. 3*b*, the forces are no longer sufficient to drive the arc over the opening B. The pressure of the quenching gas heated by the arc within the arc chamber has reached a point that the escaping quenching gas forces the ends of the arc into the nozzles 28 and 30, as shown by FIG. 3*c*, where the arc is then cooled in a particularly effective manner.

The back-up effect, however, prevents the arc base from being blown into the nozzle 28 or 30 for large current values and a correspondingly large arc diameter.

Figure 4:
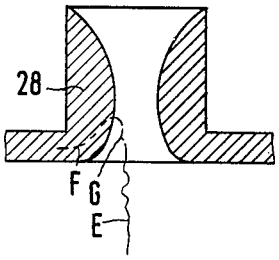
FIG. 4 is a cross-sectional view of a nozzle electrode of FIG. 1 illustrating current flow therethrough.

The entrance of the arc base into the respective nozzle shortly prior to the zero crossing is further aided by an additional loop formation between the current-carrying part of the nozzle 28, or the nozzle 30 and the adjacent part G of the arc E. The current parts F and G are shown on FIG. 4 in broken lines.

The arc generated between the ends C is acted upon, with the current path assumed above, by magnetic forces which move the arc E of FIG. 3 counter-clockwise. These forces are formed by the action of the current loop in conjunction with the effect of the current which flows in the electrodes in the opposite direction and produces the cusp field 42 and 44. These forces K acting on the arc are proportional to the square of the current and are thus large in the vicinity of the peak value of the current half-wave. As long as the magnetic forces are large, the arc in the chamber 2 rotates and in the process heats the quenching medium present therein which may be, for example, sulfur hexafluoride. The pressure in the arc chamber 2 thus rises and a flow of quenching medium through the openings of nozzles 28 and 30 into the equalization chambers 10 and 12 is produced. The volume of the arc chamber 2 in conjunction with the diameter and the profile of the nozzles 28 and 30 is chosen so that the pressure reduction in the arc chamber due to the escaping quenching gas takes longer than the respective AC half-wave by which the arc, and thus the pressure, was produced. The flow through the nozzles 28 and 30 thus lasts beyond the zero crossing of the current. Accordingly, the bases entering into the nozzles and the adjacent parts of the arc are cooled by the nozzle flow only immediately prior to the zero crossing of the arc. The nozzle flow from a practical standpoint has almost no influence on the arc as long as the current is still large, i.e., in the vicinity of the peak value of the current half-wave.

When the current approaches its zero crossing near the end of the half-wave, the magnetic driving forces K on the arc decline relatively quickly and no longer can drive the arc over the insulation gap B. This occurs at some predetermined current value. At that point, a base of the arc E is driven into the respective nozzles 28 or 30. A particularly advantageous further embodiment of the quenching arrangement of the present invention consists in providing the nozzles 28 and 30 with slots, not shown on the figure, which extend radially to the nozzles 28 and 30 in the direction of their axes. Advantageously, these slots are filled with a heat-resistant insulating material. Such slots aid in the formation of loops of current parts F and G shown on FIG. 4.

It is further advantageous if the electrodes consist essentially of an electrically conductive material such as copper or also tungsten copper and that the nozzle portion of the electrodes is made of graphite. With such an arrangement, after the base points of the arc have passed to the nozzle area, metal vapor can no longer be generated.

An essential part of the quenching arrangement of the pressent invention resides in the provision that the arc in its high-current phase heats the quenching medium in the chamber 2 and thereby produces an overpressure which causes a quenching medium flow. By this quenching medium flow, the base points of the arc are driven, during the low-current portion of the cycle into the nozzles and the parts of the arc in the vicinity of the nozzle entrance as well as inside the nozzles are cooled intensively by the flow of quenching medium.

A further advantage of the quenching arrangement of the present invention is that only a switching rod or switching tube is required to operate the breaker. A drive with relatively low power is thus sufficient since the quenching medium flow need not be generated by external forces. In addition to the illustrated embodiment where the electrodes are an open ring, it may also be advantageous in some cases to make the curvature of the electrodes such that the ends A and C do not form a ring opening but that the ends are always adjacent to an electrode part.

Figure 5:
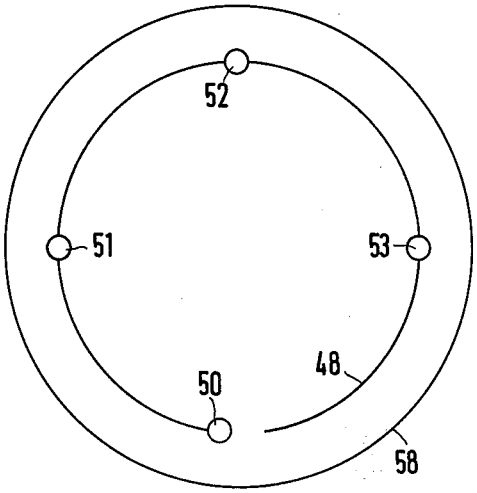
FIG. 5 is a plan view illustrating another type of electrode which may be used.

FIG. 5 shows a slightly different electrode arrangement. This illustration which is schematic in form shows an outside housing 58 for the arc chamber along with an electrode 48 having not only a nozzle 50 but additional nozzles 51, 52 and 53 arranged on the circumference of the electrode which is again shaped as an open ring. The diameter of the nozzles 50 through 53 is chosen so that the sum of the discharge cross sections, i.e., the sum of their inside diameters ensures a sufficiently slow pressure reduction in the arc chamber enclosed by the wall 58. The advantage of this configuration with a plurality of nozzles is that as the zero crossing of the current is reached, the arc no longer must travel along the entire circumference of the ring electrode 48 to get into a nozzle. Nozzles can be distributed over the circumference of the electrode 48 in an approximately uniform manner as shown on the figure. Nozzles can also be provided at points of the electrode 48 at which the ring-arc base points have a tendency to remain stationary, for example in the vicinity of deflectors or discontinuities not shown on the figure.

In some cases it may be advantageous to provide in the partition between the arc chamber and an adjacent equalization chamber one or more openings which permit equalization, i.e., a flow of gases back into the arc chamber. Such equalization may be necessary if one or more interruption processes follow after a switching operation with corresponding expansion and discharge of the gases heated by the arc.

Figure 6:
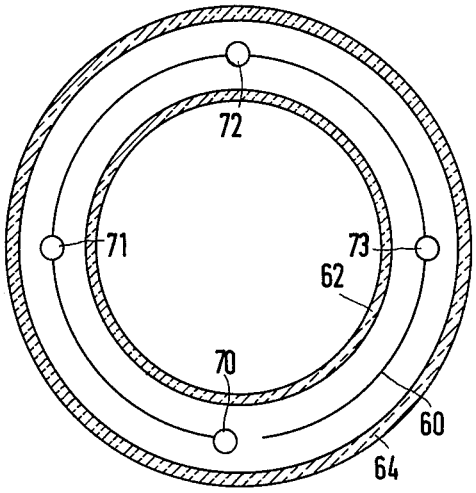
FIG. 6 illustrates a still further type of electrode.

In addition to the arc chamber of FIGS. 1 and 2, an embodiment of the arc chamber as a closed ring cylinder is also possible. Such an arrangement is shown in FIG. 6. In the arrangement illustrated thereon, an electrode 60 in the form of an open ring is arranged concentrically to chamber walls 62 and 64 such that the arc burns in the direction of the axis of the ring chamber. In this embodiment, the electrode 60 is shown as being provided with a plurality of nozzles designated 70 through 73. An equalization chamber of similar design can be arranged above or below the ring-shaped arc chamber. In the manner described above, the nozzles 70 to 73 will then open into one of these chambers.

Figure 7:
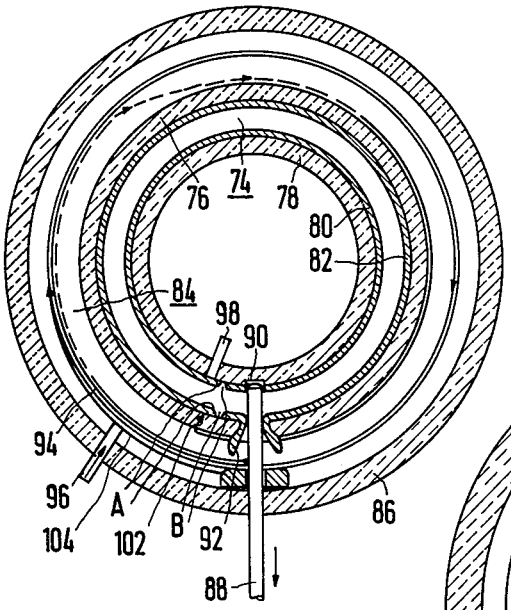
FIG. 7 illustrates a coaxial arrangement of chambers in a second embodiment of the quenching arrangement of the present invention.

FIG. 7 illustrates a further embodiment of the present invention. In the arrangement shown thereon, a ring-shaped arc chamber 74 is provided defined by side walls 76 and 78. On the inside surfaces of the walls 76 and 78 respective electrodes 80 and 82 are arranged. Thus, the electrodes are arranged concentrical to each other. As shown, they are shaped as open rings. The arc chamber 75 is surrounded by a ring-shaped equalization chamber 84 through the outer wall 86 of which a switching rod 88 is brought. Switching rod 88 establishes electrical contact between a nozzle 92 associated with electrode 82 and a pressure or spring contact 90 on the electrode 80. Furthermore, the switching rod 88 is guided in a sliding contact arranged at the inside surface of the wall 86 of the equalization chamber 84 and is at the same time connected with a blasting coil 94 arranged in the equalization chamber. The current lead 96 is coupled to the blasting coil 94. A further current lead 98 is connected to the electrode 80. The blasting coil 94 is connected so that it is switched into the circuit only by the arc drawn by the switching rod 88. In the closed condition of the arrangement, the blasting coil is shorted.

Electrodes 80 and 82 are again interrupted at the points B. The current is supplied to the bars by means of current lead 98 and a connecting conductor 102 between the blasting coil 94 and the end A of the electrode 82. During the breaking action, i.e., after the switching rod 88 is withdrawn, the quenching medium flows through the nozzle 92 into the equalization chamber 84. With the assumed direction of the current which is indicated on the current lead 96 by an arrow, the arc is driven counterclockwise because of the loop action of the current conductors. The arc burns between the concentric electrodes 80 and 82 in the radial direction moving in a circular path in a plane perpendicular to the axis of the ring chambers.

Additional magnetic driving force is generated by the fact that the current, before it gets to the beginning A of the electrode 80 through the line connection 102, is conducted around the cylindrical arc chamber 74 in multiple turns of the additional blasting coil 94 in the equalization chamber 84. In the arc chamber 74, the blasting coil 94 produces a magnetic field with essentially axial components perpendicular to the radially burning arc. These forces thus exert, on the burning arc, a magnetic force acting in the same direction as the arc's own magnetic force as long as the sense of the winding of the blasting coil 94 is properly chosen.

With the breaker closed, the blasting coil 94 is shorted by the line connection 104 between the coil 94 and the sliding contact. Thus, the coil cannot influence the circuit either by its own conductance nor its resistance with the breaker closed.

In the embodiment of FIG. 7, only a single equalization chamber 84 is provided, arranged concentric to arc chamber 74. In some cases, it may be advisable to provide a further cylindrical or ring-cylindrical equalization chamber arranged inside the arc chamber 74. In that case, the contact 90 for the end of the switching rod 88 would also be designed as a nozzle protruding through the chamber wall 78 into the further equalilization chamber not shown.

Figure 8:
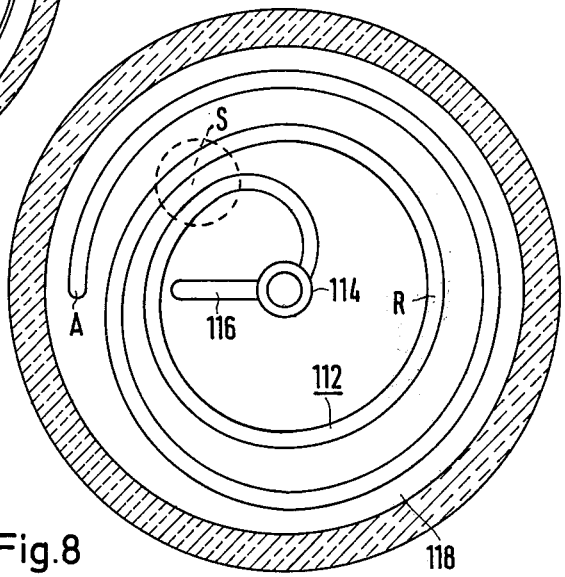
FIG. 8 illustrates a further type of electrode.

An amplification of the cusp field which is formed by the blasting coils 38 and 40 in FIG. 1 and by the electrodes 20 and 22 of FIG. 3, can be achieved by a particular design of electrodes as shown on FIG. 8. Here the electrode 112 is formed essentially as a spiral, whose end is designed as a nozzle 114 located approximately on the axis of a cylindrical chamber 118. The arc which is drawn in a nozzle 114 during the interruption process using a switching rod, not shown, can be driven away from the end of the electrode more quickly if an additional bridge 116 is arranged between the nozzle 114 and electrode 112. Current is then fed in at the end A of the electrode 112. At each point of the electrode 112, the Lorentz force acting on the arc is directed so that it is driven inward on the spiral. In order to obtain a pressure build-up which is as uniform as possible in arc chamber 118, the arc should revolve as long as possible on a ring-shaped part of the spiral designated R. For this reason, portions of the electrode 112 can be brought close together in a region designated on the figure as S. As long as the magnitude of the arc current is sufficiently large, the arc will always jump to the adjacent outside part. Arranging the nozzle 114 at the center of the arc chamber 118 has as its advantage that an approximately symmetrical quenching medium flow to the nozzle 114 is obtained.

It is also possible in this embodiment to arrange a plurality of nozzles over the electrode 112 much in the manner illustrated on FIG. 5 or 6.

Figure 9:
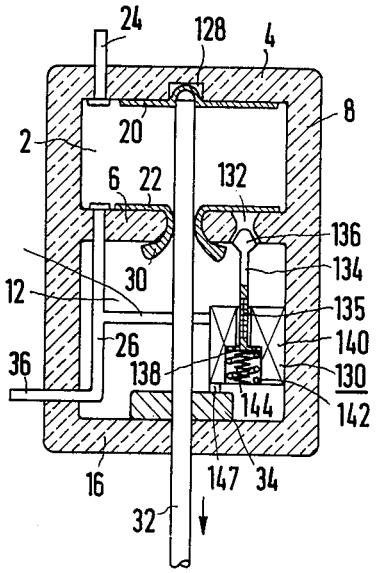
FIG. 9 is a cross-sectional view of a third embodiment of the invention in which only a single equalization chamber is provided.

FIG. 9 illustrates an additional embodiment for implementing the method of the present invention. Once again, a cylindrical member 8 is provided having a top 4 and a bottom 16. An internal partition 6 divides the structure so that it forms an upper quenching chamber 2 and a lower equalization chamber 12. In the bottom of the equalization chamber, a sliding contact 34 for a switching rod is mounted. Only the current lead 24 is brought through the top 4. The arrangement of the electrodes 20 and 22 is essentially the same as that disclosed in connection with FIG. 1 with the exception that the electrode 20 does not contain a nozzle but instead has a pressure or spring contact 128 for contacting the rod 32. As before, the rod 32 goes through and contacts the nozzle 30. Thus, all discharge from the arc chamber 2 is through the nozzle 30 of the electrode 22. The contact 128 will preferably be provided with what are referred to as finger contacts.

FIG. 9 also illustrates a further advantageous feature of the quenching arrangement of the present invention. The arc chamber 2 is provided with an additional opening 132 preferably having a variable cross-section, in particular which is controlled by the arc current. This represents an additional cross-section for discharge of the quenching medium. Preferably, the discharge opening 132 will have a nozzle shape and for adjustment has associated therewith, a closing mechanism 130. Closing mechanism 130 is controlled by the current being interrupted and opens the discharge cross section of the opening 132 preferably by steps as preset current values are exceeded. The illustrated closing mechanism essentially contains a rod 134 made of an electrically insulating material which on its end has a closing cone 136 protruding into the nozzle-shape opening 132. The other end of the rod 134 is arranged in a movable fashion along its axis in a coil 140 through which the arc current flows. The coil is fastened to the housing 8 of the quenching arrangement. The bottom portion of the rod 134 consists, for example, of iron and can be terminated at its lower end by a disc-like enlargement 138. The iron part of the rod 134 acts as a movable iron core 135 in the coil 140.

The current to be interrupted flows through the lines 36, 26 and 146 as well as through the coil 140 and a further line connection 147 to the sliding contact 34. If a short-circuit current occurs, the coil 140 is energized to the extent that it pulls in its iron core 135 in the manner of a moving-iron ammeter. With the motion of the rod 134 and its closing cone 136 therewith, the discharge cross-section of the opening 132 is released. A spring 142 inserted between the disc 138 and the bottom of the coil channel, not specifically designated, then is placed under tension. Depending on the magnitude of the current, particularly of a short-circuit current, the nozzle 132 partially opens because the motion of the rod is impeded by a second spring 144 with a stronger spring force. If a predetermined higher current value is exceeded, the spring 144 is also compressed and the cross section of the opening 132 completely released. After the current is interrupted, the springs 142 and 144 push the closing cone 136 back into the opening 132 to again close it.

Figure 10:
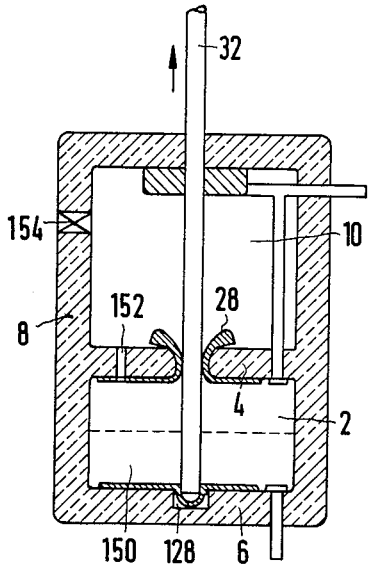
FIG. 10 is a similar view of an arrangement with a single equalization chamber which arrangement is particularly adapted for use with a liquid quenching medium.

In addition to sulfur hexafluoride $SF_6$ mentioned above, other gaseous media may also be used for quenching. For example, nitrogen and possibly also air may be used. A liquid quenching medium such as liquid sulfur hexafluoride or oil can also be used. An embodiment designed particularly for such a liquid quenching medium is that illustrated by FIG. 10. In this arrangement, a cylindrical member 8 is again provided. Within this member, the arc chamber 2 is located in the bottom defined by the bottom 6 and partition 4. An equalization chamber 10 is located above the arc chamber 2. The electrode arrangement is essentially the same as that of FIGS. 1 and 9 except that herein the nozzle 28 rather than the nozzle 30 of FIG. 9 is provided. In this embodiment, the contact 128 is in the bottom rather than the top of the arrangement. Liquid quenching medium 150 is placed in the bottom of the arc chamber 2. This liquid quenching medium 150 is partially evaporated by the arc which is drawn when the switching rod 32 is moved from the contact 128 upward. The arc is drawn between the contact 128 and the nozzle 28. Much in the manner described above, the evaporated quenching medium flows through the nozzle 28 into the equalization chamber 10. After the switching operation the evaporated quenching medium collects at the bottom of the equalization chamber 10. The return of the condensed quenching medium from the equalization chamber 10 to the arc chamber 2 can be facilitated by at least one additional opening 152.

Figure 11:
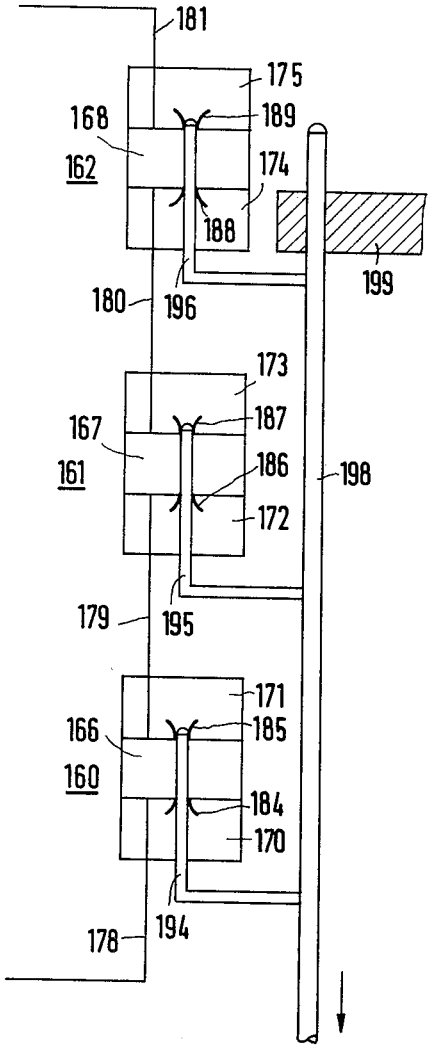
FIG. 11 is a schematic illustration of a plurality of arrangements according to the present invention connected in series.

In order to discharge the decomposition products of the quenching medium, at least one check valve 154 located in the wall 8 of the quenching arrangement can be provided. The valve will be adjusted to open at a predetermined adjustable overpressure.

Where particularly high operating voltages must be interrupted, an arrangement of the present invention such as that shown in schematic form on FIG. 11 may be used. Here, three quenching arrangements such as those described in the previous figure and designed 160, 161 and 162 coupled in series are provided. The quenching arrangements 160, 161 and 162 have respective arc chambers 166, 167 and 168. Each is shown as having two equalization chambers, the equalization chambers designated 170 and 175. The electrical input and output leads are the leads 178 coupled to one electrode of the arrangement 160 and 181 coupled to an electrode of the arrangement 162. Each electrode is provided with a nozzle, the nozzle being designated 184 through 189. In the manner described above, the nozzle permits flow of quenching medium from the arc chambers 166 through 168 into the equalization chambers 170 through 175. Series connection of the three arrangements is obtained by the connections 179, connecting the arrangements 160 and 161 and 180 connecting the arrangements 161 and 162. Each of the quenching arrangements has associated therewith a switching rod, the individual switching rods being designated as 194, 195 and 196. Preferably, each of the switching rods is connected to a common drive 198 which is provided with a separate guide 199. With this arrangement, all the quenching arrangements 160, 161, 162 are operated by the common drive 198 together and simultaneously. It should be noted that the quenching arrangements can be arranged in tandem, as shown on FIG. 11 as well as side by side.

Because of their particularly compact and space-saving type of construction, the quenching arrangements of the present invention are particularly well suited for installation in partially or completely encapsulated switching systems.

Thus, an improved method of arc quenching and a number of embodiments for carrying out that method have been disclosed. Although a particular method and particular embodiments have been illustrated and described, it will be obvious to those skilled in the art that various modifications may be made without departing from the spirit of the invention which is intended to be limited solely by the appended claims.

What is claimed is:

1. Apparatus for quenching an arc in an electric AC circuit breaker having an arc chamber in which the arc rotates between two open electrodes in a quenching medium comprising:

a. first and second electrodes arranged coaxially and parallel to each other in the arc chamber;

b. first and second leads coupled to the one respective end of each of said first and second electrodes;

c. a nozzle formed at the other end of at least one of said electrodes, said nozzle projecting through a wall of the arc chamber;

d. an equalization chamber on the other side of any wall containing a nozzle;

e. means for selectively electrically coupling said first and second electrodes and for drawing an arc therebetween; and f. the discharge cross section of said nozzle in conjunction with a predetermined volume of the arc chamber being designed so that the overpressure produced by the heated quenching medium in said arc chamber is maintained beyond the zero crossing of the AC current.

2. Apparatus according to claim 1 wherein said electrodes are ring electrodes.

3. Apparatus according to claim 2 wherein only one electrode is equipped with a nozzle and the other end of the electrode not containing said nozzle is a pressure contact and means for coupling comprise a switching rod protruding through said nozzle from the equalization chamber and contacting said pressure contact, said switching rod being movable along its axis for drawing an arc between said contact and said nozzle.

4. Apparatus according to claim 3 and further including at least one ring contact in an equalization chamber in the form of a sliding contact through which said switching rod is brought.

5. Apparatus according to claim 4 wherein the other ends of both said first and second electrodes are designed as nozzles and said means for coupling comprise a switching rod movable in the direction of its axis coupling said two nozzles.

6. Apparatus according to claim 4 wherein at least one of said two nozzles is equipped with a pressure contact.

7. Apparatus according to claim 5 and further including at least one ring contact in an equalization chamber in the form of a sliding contact through which said switching rod is brought.

8. Apparatus according to claim 1 wherein each electrode of said first and second electrodes forms a plurality of turns approximately in spiral fashion, the electrodes being connected electrically in series and magnetically in opposition, the mutual spacing of turns on each of said electrodes having at least one narrow point.

9. Apparatus according to claim 8 wherein said arc quenching chamber is cylindrical in shape and wherein said nozzle is approximately along the central axis of said chamber.

10. Apparatus according to claim 1 wherein at least one of said electrodes contains a plurality of nozzles formed at several points thereon, each of said nozzles forming an opening in the wall of said chamber communicating with said equalization chamber.

11. Apparatus according to claim 1 wherein said electrodes are made of at least two different materials.

12. Apparatus according to claim 11 wherein the major portions of said electrodes are made of metal and the nozzle portion of graphite.

13. Apparatus according to claim 1 and further including a magnetic blasting coil arranged in said equalization chamber.

14. Apparatus according to claim 13 wherein at least one short-circuited turn is associated with said blasting coil.

15. Apparatus according to claim 1 wherein said arc chamber is a cylindrical ring chamber having a top and bottom through at least one of which said nozzles projects.

16. Apparatus according to claim 1 wherein said arc chamber and said equalization chamber are in the form of ring cylinders with said arc chamber and equalization chamber being arranged concentrically to each other with said electrodes on the inside cylindrical surfaces of said arc chamber. arc current flows.

17. Apparatus according to claim 16 wherein said arc chamber is surrounded by said equalization chamber and wherein additional turns are provided in said equalization chamber through which the arc current flows.

18. Apparatus according to claim 17 and further including at least one short-circuited turn associated with said additional turns.

19. Apparatus according to claim 1 wherein said electrodes are inserted in slots formed in the wall of said arc chamber.

20. Apparatus according to claim 1 wherein a liquid quenching medium is provided in said arc chamber.

21. Apparatus according to claim 20 wherein said liquid quenching medium is liquid sulfur hexafluoride $SF_6$.

22. Apparatus according to claim 1 wherein at least one check valve set to open at a predetermined pressure in the arc chamber is provided between said arc chamber and said equalization chamber to release an additional discharge cross section to the equalization chamber.

23. Apparatus according to claim 1 wherein at least one safety valve is provided in the wall of said equalization chamber preset to open at a predetermined measure for discharge to the outside.

24. Apparatus according to claim 23 wherein said safety valve is a burst diaphragm.

25. Apparatus according to claim 1 and further including:

a. a nozzle shaped opening between said arc chamber and said equalization chamber;

b. means located in said equalization chamber for closing off said opening; and c. magnetic means responsive to the arc current for moving said closing off means.

26. Apparatus according to claim 25 wherein said closing off means comprise a closing portion adapted to fit in said opening having on its other end an iron portion and said means for moving comprise a magnet coil, said iron portion being movable within said magnet coil.

27. Apparatus according to claim 26 and further including means to provide a stepwise movement of the closing mechanism in dependence on the current to be interrupted.

28. Apparatus according to claim 27 wherein said means for stepwise motion comprise at least two springs of different strength arranged to become effective successively with the motion of said closing of means.

29. Apparatus according to claim 1 for use in interrupting a high voltage wherein a plurality of said arrangements are placed in series and further including common drive means for actuating the switching rods of all said arrangements in series.

30. Apparatus according to claim 1 in combination with an at least partially encapsulated switching installation.

* * * * *

UNITED STATES PATENT AND TRADEMARK OFFICE

CERTIFICATE OF CORRECTION

PATENT NO. : 3,947,649

DATED : March 30, 1976

INVENTOR(S) : WALTER HERTZ

It is certified that error appears in the above-identified patent and that said Letters Patent are hereby corrected as shown below:

Column 3, line 54, "this" should read -- thus --.

Col. 13, line 33 delete "and" and substitute -- through --.

Signed and Sealed this

Fourth Day of January 1977

[SEAL]

*Attest:*

RUTH C. MASON
*Attesting Officer*

C. MARSHALL DANN
*Commissioner of Patents and Trademarks*